US009815053B2

(12) United States Patent
Moriarty et al.

(10) Patent No.: US 9,815,053 B2
(45) Date of Patent: Nov. 14, 2017

(54) LIQUID END ASSEMBLY FOR A MULTICHANNEL AIR DISPLACEMENT PIPETTE

(71) Applicant: Rainin Instrument, LLC, Oakland, CA (US)

(72) Inventors: Kent Gordon Moriarty, Pinole, CA (US); Christopher Brian Elginsmith, Oakland, CA (US); Brian Matthew Husmann, Oakland, CA (US)

(73) Assignee: Mettler-Toledo Rainin, LLC, Oakland, CA (US)

( * ) Notice: Subject to any disclaimer, the term of this patent is extended or adjusted under 35 U.S.C. 154(b) by 643 days.

(21) Appl. No.: 13/742,305

(22) Filed: Jan. 15, 2013

(65) Prior Publication Data

US 2014/0199216 A1 Jul. 17, 2014

(51) Int. Cl.
*B01L 3/02* (2006.01)

(52) U.S. Cl.
CPC ..... *B01L 3/0231* (2013.01); *B01L 3/0217* (2013.01); *B01L 3/0279* (2013.01); *B01L 2200/025* (2013.01)

(58) Field of Classification Search
CPC .... B01L 3/0231; B01L 3/0217; B01L 3/0279; B01L 2200/025
See application file for complete search history.

(56) References Cited

U.S. PATENT DOCUMENTS 3,855,868 A * 12/1974 Sudvaniemi ..... 73/863.32
4,779,467 A * 10/1988 Rainin et al. ..... 73/864.17
4,879,431 A * 11/1989 Bertoncini ..... 435/308.1
5,021,217 A * 6/1991 Oshikubo ..... 422/516
5,454,268 A * 10/1995 Kim ..... 73/864.01
5,456,879 A * 10/1995 Suovaniemi ..... B01L 3/0217 422/501
5,895,761 A * 4/1999 Jacobs ..... B01L 3/02 422/408
6,499,363 B1 * 12/2002 Morimoto ..... B01L 3/0231 73/864.01
6,833,114 B1 * 12/2004 Christen ..... B01L 3/0279 422/525
7,673,532 B2 3/2010 Wilmer
8,201,466 B2 6/2012 Roussel
8,899,118 B1 * 12/2014 Seguin ..... B01L 3/0279 73/863.32

(Continued)

OTHER PUBLICATIONS

Schicke, M, Ewald, K "The eppendorf research plus pipette-lightweight, reliable, and ergonomic" Applications; Technical Report; Note 197; pp. 1-5; published Aug. 2010.*

(Continued)

*Primary Examiner* — Sean E Conley
*Assistant Examiner* — Benjamin R Whatley
(74) *Attorney, Agent, or Firm* — Clarke A. Wixon

(57) ABSTRACT

A handheld multichannel air displacement pipette is modular in construction and includes compliant joints and molded plastic components in place of various machined metal, glass, and ceramic components found in traditional multichannel pipettes. These improvements are made without sacrificing performance in channel-to-channel consistency, accuracy, and precision. The multichannel pipette is inexpensive to manufacture, lightweight, reliable, and easy to assemble and service.

12 Claims, 5 Drawing Sheets

(56) References Cited

U.S. PATENT DOCUMENTS

| | | | | |
|---|---|---|---|---|
| 2005/0155439 | A1* | 7/2005 | Belgardt | 73/864.01 |
| 2005/0163404 | A1* | 7/2005 | Shishido et al. | 384/100 |
| 2008/0006100 | A1* | 1/2008 | Wilmer | 73/864.16 |
| 2008/0184823 | A1* | 8/2008 | Kneucker et al. | 73/864.16 |
| 2009/0064801 | A1* | 3/2009 | Roussel | 73/864.13 |
| 2009/0120967 | A1* | 5/2009 | Bensley | F04B 9/02 222/333 |
| 2009/0158862 | A1* | 6/2009 | Londo | G01N 35/0099 73/864.14 |
| 2011/0206577 | A1* | 8/2011 | Leckebusch | 422/520 |
| 2012/0156098 | A1* | 6/2012 | Sano | G01N 35/10 422/68.1 |
| 2013/0130369 | A1* | 5/2013 | Wilson | B01L 3/5085 435/289.1 |
| 2013/0239706 | A1* | 9/2013 | Link | 73/864.01 |
| 2014/0147349 | A1* | 5/2014 | Schmidt | 422/522 |

OTHER PUBLICATIONS

Definition and synonym of compliant; The Free Dictionary.com.*
Definition and synonym of compliant; Dictionary.com.*

* cited by examiner

LIQUID END ASSEMBLY FOR A MULTICHANNEL AIR DISPLACEMENT PIPETTE

FIELD OF THE INVENTION

The invention relates to liquid-handling pipettes, and more particularly to handheld multichannel air-displacement pipettes operable to measure and transfer multiple substantially identical small volumes of liquid simultaneously.

BACKGROUND OF THE INVENTION

Handheld multichannel air-displacement pipettes are well known, and have been commonplace in laboratory settings for decades. Such pipettes are particularly useful for fast, convenient transfer of liquid samples between microtubes and multi-well plates, for example. Generally, multichannel pipettes have multiple nozzles arranged in one or two evenly-spaced rows, and the nozzles are configured to receive disposable pipette tips similar or identical to tips used on single-channel handheld pipettes. See U.S. Pat. No. 4,779,467, which is hereby incorporated by reference as though set forth in full, for an example of a traditional multichannel pipette configuration.

Because multichannel pipettes are handled by laboratory personnel so frequently, and are often used for long uninterrupted periods of time, ergonomic considerations are paramount. However, in order to maintain accuracy and reliability, some tradeoffs have often been made. Multichannel pipettes are often uncomfortably large and heavy, with precision metal parts used to ensure accuracy, consistency, and durability. Not only are such metal parts heavy, they tend to be expensive to manufacture as a result of the labor-intensive processes necessary to assemble them.

Channel-to-channel consistency is an important quality for multichannel pipettes. Unintended variation may result in experimental anomalies or other poor results. Accordingly, as noted above, multichannel pipettes made with bulky, heavy parts have proven to be reliable scientific tools. However, in some cases, this weight can result in fatigue over long periods of usage.

Accordingly, a need exists for an adjustable multichannel pipette that avoids the limitations of the prior art. Such a pipette would include advantageous features, such as a compact design that is reliable, accurate, capable of precise fluid measurement, yet lightweight. These characteristics and features are achieved while retaining ease of assembly and service, and providing excellent channel-to-channel volume measurement consistency and performance.

SUMMARY OF THE INVENTION

A handheld multichannel air displacement pipette according to the invention replaces many of the bulky, heavy, metal components of traditional multichannel pipettes with smaller, lighter weight replacements.

The liquid end portion of a traditional multichannel pipette often includes a metal pushrod, multiple polished metal pistons, and other metal parts. These components are often made of stainless steel, a material that offers excellent resistance to corrosion and wear but is quite dense and heavy. A multichannel pipette according to the invention replaces the stainless steel pushrod and various other components with molded plastic counterparts without significantly sacrificing reliability, accuracy, or precision.

The pushbar in a multichannel pipette is a component that transfers the movement of a single plunger rod—often manually controlled by a pushbutton—into corresponding equal movement of multiple parallel pistons. The pushbar in a multichannel pipette according to the invention is guided and kept parallel to ensure channel-to-channel consistency via a bearing that tracks a single stainless steel guide shaft; the guide shaft is made hollow to further reduce weight.

In contrast to traditional multichannel pipettes, which often use individual springs for this purpose, head ends of the pistons are retained in the pushbar by way of small, light, stainless steel spring clips. These clips reduce or eliminate axial play between the pistons and the pushbar, and retain and help center the pistons automatically.

As with traditional handheld multichannel pipettes, a plurality of cylinders is mounted within the housing, each of which receives an air displacement piston mounted for axial movement therein in response to movement of the plunger rod, via the pushbar. Each of the cylinders is coupled to a nozzle with an open end extending from the bottom wall of the housing. As in traditional pipettes, the nozzles are used to mount and release disposable pipette tips.

In a multichannel pipette according to the invention, the nozzles and air displacement cylinders are also fabricated from molded plastic. A modular configuration allows for simple, tool-less removal and replacement of nozzles, cylinders, seals, and pistons as necessary once the housing has been opened. This modular construction facilitates simple manufacturing and greatly improved service. The molded parts also greatly reduce weight, by reducing the need for heavier precision-machined metal components in the cylinder, piston, pushrod, and pushbar assemblies.

A multichannel pipette according to the invention further includes a compliant interface between the pushrod and the pushbar. This compliant interface allows for some radial (i.e. angular) play in the pushrod resulting from minor manufacturing variations or attachment inaccuracies between the pipette body and plunger rod, and the connection of those components to the pushrod within the multichannel pipette liquid end. Axial play, however, is minimized. As a result of the compliant interface, the pushbar is able to remain parallel and centered on the guide shaft to ensure channel-to-channel consistency, accuracy, and precision, while allowing small radial angular offsets of the pushrod.

Accordingly, as set forth above and described in further detail below, a handheld multichannel air displacement pipette according to the invention is modular in construction and includes molded plastic components as replacements for various machined metal, glass, and ceramic components in traditional multichannel pipettes. These improvements are made without sacrificing performance in channel-to-channel consistency, accuracy, and precision. The resulting multichannel pipette is lightweight yet robust and reliable, easier to assemble and service than traditional multichannel pipettes, and may be considerably less expensive to build.

Because of the light weight and low forces required to operate a multichannel pipette according to the invention, it offers improved ergonomics and less operator fatigue than heavier traditional models.

BRIEF DESCRIPTION OF THE DRAWINGS

These and other objects, features, and advantages of the invention will become apparent from the detailed description below and the accompanying drawings, in which.

DETAILED DESCRIPTION OF THE INVENTION

The invention is described below, with reference to detailed illustrative embodiments. It will be apparent that a multichannel air displacement pipette according to the invention may be embodied in a wide variety of forms. Consequently, the specific structural and functional details disclosed herein are representative and do not limit the scope of the invention.

Figure 1:
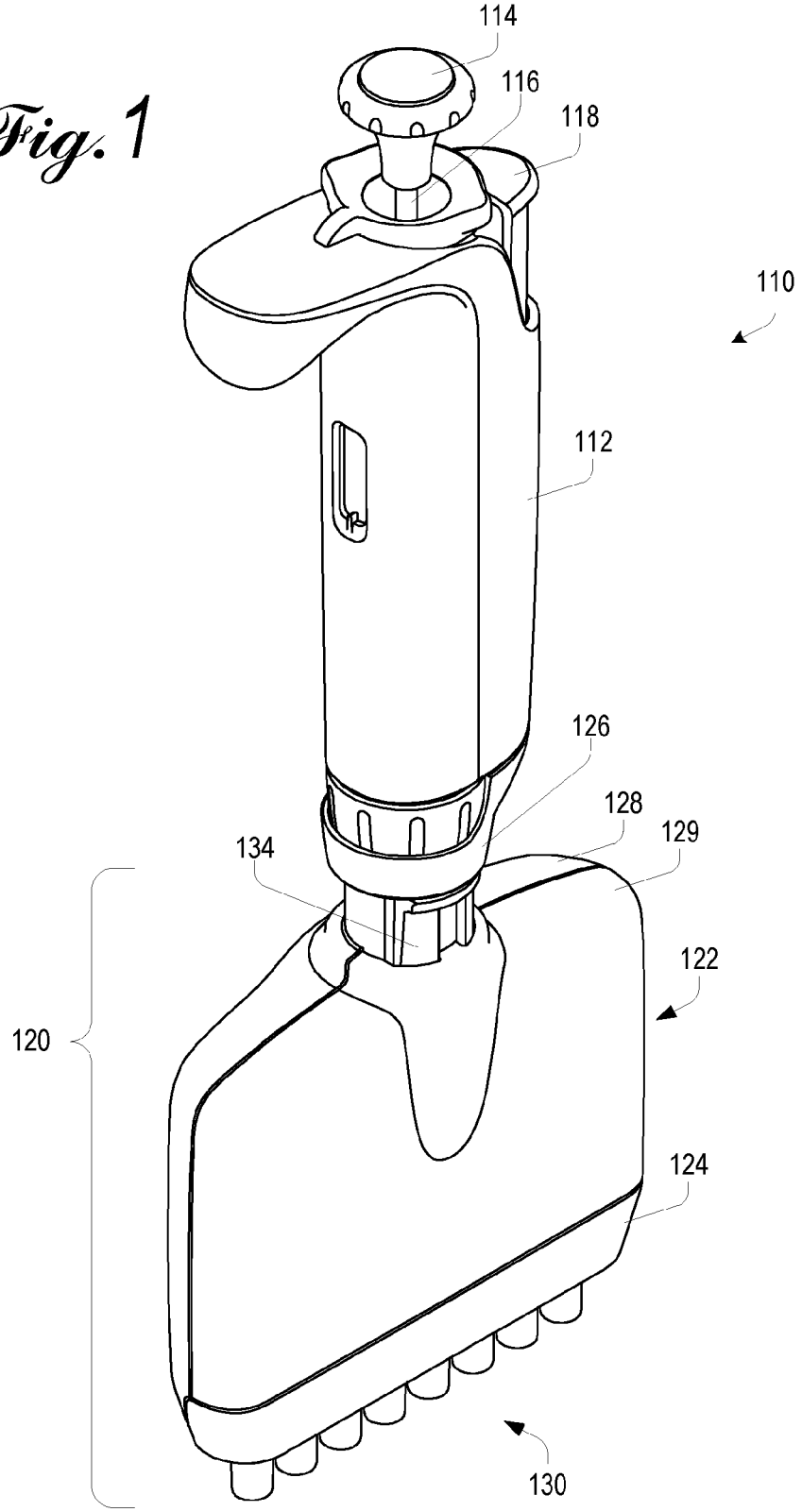
FIG. 1 is an external view of an exemplary complete handheld multichannel pipette, including a body and a liquid end according to the invention.

Referring initially to FIG. 1, an overview illustration of a handheld multichannel pipette 110 according to the invention is presented.

The pipette 110 includes a hand-holdable body 112 which contains a volume adjustment mechanism and a plunger button 114 that is movable axially toward the body. In the illustrated pipette 110, as the plunger button is operated by applying pressure thereto, this movement is transferred through a plunger rod 116 (largely internal to the body) to a liquid end assembly 120. In the disclosed embodiment, the liquid end assembly 120 includes a relatively low-profile housing 122.

The housing 122 includes a rear portion 128 and a front portion 129, the front portion 129 being detachable from the rear portion 128 to expose the internal components of the liquid end assembly 120 for manufacture or service, as will be illustrated and described in further detail below.

The operation of one form of exemplary manual pipette is explained in U.S. Pat. No. 5,700,959 to Homberg, entitled "Manual Pipette with Magnet Assist," which is hereby incorporated by reference as though set forth in full herein. The plunger button 114 is spring-biased toward its uppermost position defined by a volume setting of the pipette. As explained in the Homberg patent, the user depresses the plunger button 114 toward a soft stop defining a home position, and past the home position to a blowout position while dispensing fluids.

Although FIG. 1 illustrates a manual pipette, it will be recognized that electronically controlled motor driven pipettes may also be used. In such cases, the plunger rod 116 is driven axially in response to control from an embedded processor.

As illustrated, the liquid end assembly 120 includes eight protruding nozzles 130 arranged in a row. As described above, pipettes having six, eight or twelve nozzles in a single row, or sixteen or twenty-four nozzles in two rows of eight of twelve are currently available in traditional form. An embodiment of the invention employing eight nozzles in a single row will be discussed in detail herein, but the disclosed invention is applicable to multichannel pipettes of various configurations.

In operation, replaceable pipette tips may be and generally are attached to each of the nozzles 130, for example as described in U.S. Pat. No. 6,168,761 to Kelly et al., which is hereby incorporated by reference as though set forth in full herein. When the pipette 110 is operated as described above, by manipulating the plunger button 114 to aspirate and dispense fluid through the pipette tips, air is displaced from the cylinders and out of the nozzles, driving liquid into or out of the attached pipette tips as desired by the user.

The liquid end assembly 120 includes a tip ejector 124 actuated by depressing an ejector button 118 (on the body 112 of the pipette), which transfers force to the tip ejector 124 through a mechanism internal to the pipette body 112 to an ejector sleeve 126 at a proximate end of the liquid end assembly. The ejector sleeve 126 transfers its axial movement to the tip ejector 124 via a projecting upper end 134 of the ejector 124 adjacent to the sleeve 126. When the ejector button 118 is depressed, the tip ejector 124 is caused to move axially, pushing off any tips mounted then on the nozzles 130. When the ejector button 118 is released, the ejector 124 is spring-biased back to its rest position adjacent to the housing 122, allowing new tips to be mounted.

In the disclosed embodiment, the housing 122 and external portions of the pipette body 112 are made from a suitable rigid polymer such as a polybutylene terephthalate (PBT) and polycarbonate blend.

Figure 2:
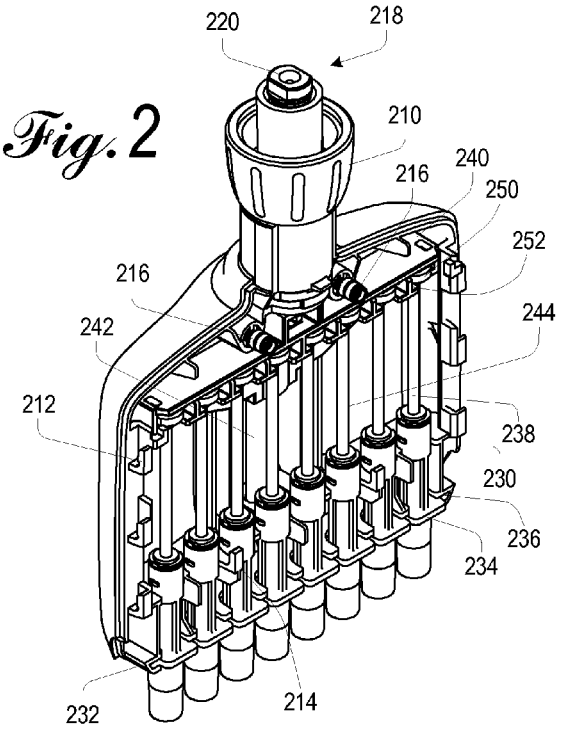
FIG. 2 is a view of an exemplary liquid end portion of the handheld multichannel pipette of FIG. 1 with a portion of its housing and the tip ejector removed, allowing internal components to be seen.

Referring now to FIG. 2, the liquid end assembly 120 of FIG. 1 is illustrated with the front portion 129 (FIG. 1) of the housing 122 removed to expose the internal components of the liquid end assembly 120. The exemplary liquid end assembly shown in FIG. 2 and described herein is designed to allow the front portion 129 to be easily removed to service the internal components, which are primarily anchored to the rear portion 128 of the housing 122. Accordingly, the liquid end assembly 120 is still operational and may be observed and inspected with the front portion 129 removed.

To attach the front portion 129 and the rear portion 128 together, the rear portion 128 includes a plurality of L-shaped features 212 and 214 arranged to interlock with counterpart features on the front portion 129. To attach the front portion 129 to the rear portion 128, the front portion 129 (FIG. 1) is placed over the rear portion 128 and slid into place, causing the L-shaped features 212 and 214 to interlock with the corresponding features on the front portion 129; screws 216 are then fastened to prevent the portions 128 and 129 from sliding apart. The screws 216 and L-shaped features 212 and 214 cooperatively act to keep the housing 122 closed around its entire periphery. To remove the front portion 129 from the rear portion 128, the screws 216 are removed and the portions are slid apart. This is considered a particularly advantageous assembly method, resulting in easy assembly and disassembly and light weight. Other configurations and means of attachment between the front portion 129 and the rear portion 128, and among the various components of the liquid end assembly 120 are, of course, possible and are in keeping with the scope of the present invention.

In the disclosed embodiment, a coupling nut 210 attaches the liquid end assembly 120 to the body 112 of the pipette 110 (FIG. 1). The coupling nut 210 easily screws and unscrews from a threaded distal portion of the pipette body 112.

A pushrod 218 protrudes from a proximal end of the liquid end assembly 120. The pushrod 218 includes a cupped receptacle 220 at its proximal end, adapted for coupling with a rounded adjoining distal end portion extending from the plunger rod 116 in the pipette body 112. A bias spring 312 (FIG. 3) urges the pushrod 218 upward and toward the pipette body 112, which keeps the pushrod 218 and the plunger rod 116 closely coupled. This joint may be disassembled simply by loosening the coupling nut 210 and pulling the plunger rod and pushrod apart.

The joint between the pipette body 112 and the liquid end assembly 120 is free to rotate, even when the coupling nut 210 attaches the liquid end assembly 120 to the body of the pipette 112. Accordingly, a user of the pipette is free to position the liquid end assembly 120 in any desired radial orientation for convenient operation.

The illustrated liquid end assembly 120 includes eight nozzles 130, each situated at the distal end of a corresponding cylinder 230. The cylinders 230 are affixed to a bottom wall 232 of the rear portion 128 of the housing 122; each cylinder 230 is fabricated from a molded polymer material and is formed with a radial protruding flange 234 adapted to fit into a corresponding cylinder slot 236 defined by the housing 122. When the flange 234 is fully inserted into its cylinder slot 236 and the front portion 129 of the housing 122 is affixed to the rear portion 128, the cylinders 230 are effectively anchored in place. In the disclosed embodiment, the flange 234 is keyed in such a way that it fits into the corresponding cylinder slot 236 in only one orientation, to ensure that all cylinders are appropriately and correctly aligned.

As in traditional multichannel pipettes, each cylinder 230 receives an axially movable piston 238, and each piston 238 is anchored at its proximal end to an axially movable pushbar 240. In turn, the pushbar 240 is attached to the pushrod 218. Accordingly, then, when the pushrod 218 is moved axially during operation of the pipette 110 via depression of the plunger button 114, that axial movement of the pushrod 218 is transferred to the pushbar 240 and the pistons 238, each of which moves axially a distance equal to the movement of the plunger button 114. Each of the pistons 238 forms an air-tight seal with its corresponding cylinder 230, and accordingly, the movement of the pistons 238 into and out of the cylinders 230 displaces a substantially equal amount of air in each cylinder and the attached pipette tips, allowing liquid to be aspirated into or dispensed from the tips.

In the disclosed embodiment, the cylinders 230 and at least portions of the pistons 238 are molded from a suitable rigid chemical-resistant polymer, such as polyetherimide (PEI). This material and construction have shown to provide satisfactory sealing performance, light weight, and pipetting accuracy.

Figure 3:
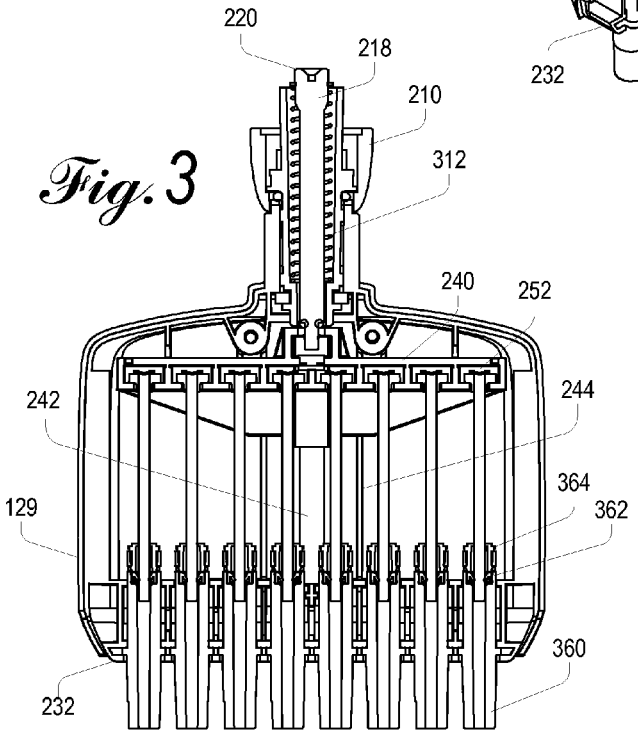
FIG. 3 is a cutaway view of the liquid end portion of FIG. 2.

As seen in FIGS. 2 and 3, the pushbar 240 is mounted within the liquid end assembly 120 on a guide shaft 242 extending axially through the liquid end assembly 120 and mounted to the rear portion 128 of the housing 122. As will be illustrated below in connection with FIG. 4, the pushbar 240 employs a brass bearing to track the guide shaft and maintain a strict perpendicular relationship between the pushbar 240 and the pushrod 218, thereby assuring consistent performance across the channels of the disclosed multichannel pipette. Advantageously, the pushbar 240 is also fabricated from PEI, and the guide shaft 242 is a hollow stainless steel rod. The stainless steel guide shaft 242 is dimensioned to ensure that it remains straight and rigid within the liquid end assembly 120, but thin enough to ensure the liquid end assembly does not include excess weight.

The rear portion 128 of the housing 122 further includes linear projections 244. These linear projections 244 are positioned to guide the rear of the pushbar 240, preventing it from rotating about either the guide shaft 242 or the pushrod 218 without imparting substantial friction to the axial movement of the pushrod 218 and pushbar 240.

Each piston 238 includes a proximal flared head 250 sized to fit into a corresponding piston head slot 252 formed in the pushbar 240. As illustrated, the pushbar 240 includes eight slots, one for each of the eight pistons 238 in the eight-channel pipette shown. The piston head slots 252 are sized to accommodate the flared heads 250 of the pistons 238, with some extra space made available above the flared heads 250 for retention spring clips (discussed below in connection with FIGS. 4 and 5).

With the illustrated configuration, a multichannel pipette liquid end assembly 120 according to the invention is easily assembled and disassembled. As noted above, each of the cylinders 230 fits into a corresponding cylinder slot 236 defined by the rear portion 128 of the housing 122. Similarly, as the flared piston heads 250 fit into corresponding piston head slots 252 in the pushbar 240, each individual cylinder 230 and corresponding piston 238 may be added to or removed from the liquid end assembly 120 by simply sliding those parts away from the rear portion 128 of the housing 122. This facilitates simple manufacturing and service. If only one nozzle 130 or cylinder 230 has been damaged or is operating incorrectly, that specific component may be replaced without disturbing any of the other channels of the pipette 110.

FIG. 3 illustrates many of the same components shown in FIG. 2, but in cutaway form with the operation of the cylinders 230 more clearly visible.

The illustrated embodiment represents an eight-channel liquid end, where each channel has a 50 μl displacement capacity. In this embodiment, it will be noted that each cylinder 230 includes a cylinder body 360, a skirted seal 362, and a seal retainer 364. The seal retainers 364 are fabricated from molded polyoxymethylene (POM), while the skirted seals 362 are EPDM (ethylene propylene diene monomer) rubber, which has been found to provide advantageous sealing properties in a liquid end according to the invention, while having useful chemical resistance, wear resistance, and long life. The seals remain stationary near the proximal ends of the cylinders 230; each skirted seal 362 forms a substantially air-tight seal against an outer surface portion of its corresponding piston 238.

Figure 5:
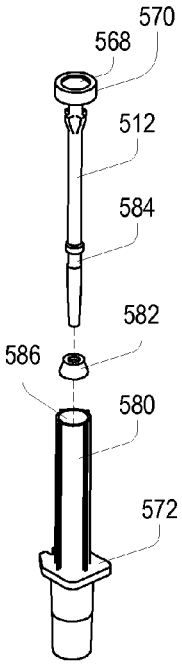
FIG. 5 is an exploded view of a second embodiment of a piston and cylinder assembly of an embodiment of a liquid end portion of a pipette according to the invention.

It is anticipated that different pipette capacities may call for different seal designs. For example, a 10 μl or 20 μl multichannel liquid end assembly may include compressed nitrile rubber o-rings, held between the cylinder body and a seal retainer, for sealing against the axially moving piston. Such o-rings would also constitute stationary seals. Or larger-volume liquid end assemblies (such as 100 μl, 200 μl, or larger) may include moving seals, in which an annular EPDM rubber lip seal is affixed near the proximal end of each of the axially moving pistons, and the lip seal moves axially with the piston, sealing against a smooth inner surface of the cylinder. Such an alternative embodiment is illustrated in FIG. 5 and discussed below. These alternative seal designs are also well adapted to displace air within pistons in multichannel pipettes. Other piston and cylinder seal configurations are well known and may be employed within the scope of the present invention.

Advantageously, a suitable perfluoropolyether (PFPE) or other grease may be used to lubricate the sealing surfaces between each piston 238 and the corresponding cylinder seal 362 described above, at the interface between the seals and the piston (in the illustrated embodiment) or the seals and the cylinder walls (in the moving-seal embodiment described above). PFPE grease is substantially inert, insoluble, chemical resistant, and heat resistant, and tends to avoid migration; these characteristics are considered particularly useful in lubricating pipette seals.

Figure 4:
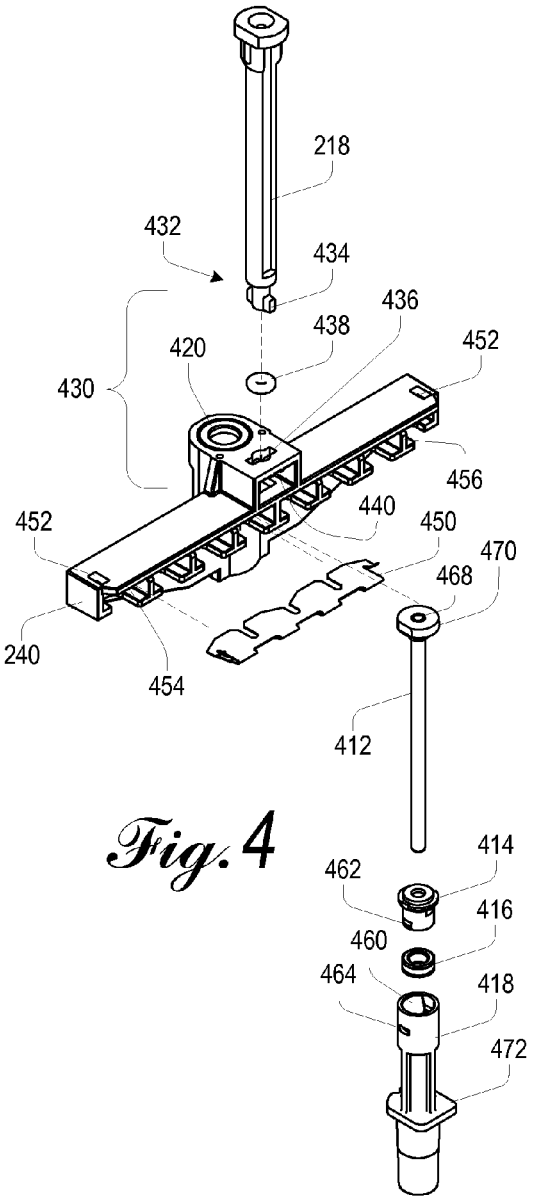
FIG. 4 is an exploded view of a first embodiment of a pushrod, pushbar, piston, and cylinder assembly of an embodiment of a liquid end portion of FIG. 2.

Several inventive features of the disclosed multichannel liquid end assembly 120 (FIG. 1) are clearly illustrated in FIG. 4, which illustrates the pushrod 218, the pushbar 240, a spring clip 450, and a single piston-cylinder assembly including a piston 412, a seal retainer 414, a skirted seal 416, and a cylinder 418.

As noted above, the pushbar 240 (FIG. 2) is coupled to a tubular brass bearing 420 (FIG. 4). The liquid end assembly 120 (FIG. 1) is assembled so that an annular inner surface of the bearing tracks the stainless steel guide shaft 242 (FIG. 2), which has a smooth, polished outer surface. The interface between the smooth guide shaft 242 and the brass bearing provides a low-friction guide upon which the pushbar 240 is free to move axially within the housing 122, with minimal radial play. In the disclosed embodiment, the brass bearing 420 is press-fit into a sleeve defined by the pushbar 240.

The bearing 420 fits closely upon the guide shaft 242, and accordingly, the pushbar 240 is prevented from skewing and tends to remain perpendicular to the guide shaft 242. It will be noted that pushbar skew is a significant contributor to channel-to-channel volume inconsistencies in multichannel pipettes. Although central channels, located close to the pushrod 218, may have close to the desired performance, outboard channels (near either end of the row of nozzles 130) may have either a shorter-than-intended or longer-than-intended stroke as a result of pushbar skew or misalignment. The guide shaft 242 and bearing 420 arrangement set forth herein has been found to counteract such accuracy-defeating skew.

The pushrod 218 is coupled to the pushbar 240 through a compliant bayonet joint 430. A distal end 432 of the pushrod 218 includes a T-shaped flange 434. The T-shaped flange 434 fits into a corresponding bayonet slot 436 defined by the pushbar 240, and during manufacture of the liquid end assembly 120, a resilient o-ring 438 (nitrile rubber in the disclosed embodiment) is placed over the T-shaped flange 434 of the pushrod, the T-shaped flange 434 is inserted into the bayonet slot 436, and the pushrod 218 is rotated approximately ninety degrees to lock the bayonet joint 430 together. The T-shaped flange 434, bayonet slot 436, and o-ring 438 cooperatively result in a compliant joint that is substantially free of axial play yet able to accommodate some radial angular movement of the pushrod, such as that caused by axial displacement of the cupped receptacle 220 (FIG. 2) when the liquid end assembly 120 is mounted to a pipette body 112. This ability to tolerate some minor misalignment between the pipette body 112 and the liquid end assembly 120, without any substantial effect on the accuracy of liquid measurement using a pipette 110 according to the invention, is an advantageous feature of a pipette according to the invention.

In a liquid end assembly 120 according to the invention, the compliant bayonet joint 430 may be kept in its affixed and locked orientation (ninety degrees rotated after insertion) by one or more protruding features on an upper surface 440 of the pushbar 240 under the bayonet slot 436; compression of the resilient o-ring 438 urges the T-shaped flange 434 against that upper surface 440, and accordingly, even a small protrusion extending from the upper surface 440 will assist in avoiding undesired pushrod rotation.

It will be noted that other forms of compliant joints may be substituted for the bayonet joint 430 in a pipette 110 according to the invention. In the disclosed embodiment, the bayonet joint 430 is captive. However, in alternative embodiments, non-captive joints (similar to the cupped joint at the proximal end of the pushrod 218) or ball-and-socket joints may afford similar advantages, provided any non-captive joint is sufficiently spring-biased together to avoid undesired slack.

As described above with reference to FIG. 3, the cylinder assemblies employed in a liquid end assembly 120 according to the invention include several components: the seal retainer 414, the skirted seal 416, and the cylinder 418. The skirted seal 416 is inserted into a suitably sized recess 460 at a proximal end of the cylinder 418, and the seal retainer 414 snaps into place over the seal 416, securing the seal 416 firmly in position within the cylinder 418. This assembly process can be accomplished without tools, as the disclosed seal retainer 414 includes at least one resilient tab 462 adapted to snap into a mating receptacle 464 defined by the cylinder 418. Disassembly is also simple, as a tool may be employed to simply depress the tab 462 within the receptacle 464, allowing the seal retainer 414 to be withdrawn from the cylinder 418. It will be noted that the tab 462 and receptacle 464 are positioned proximal to the seal 416 within the cylinder 418, and accordingly, the airtightness of the seal between the piston 412 and the cylinder 418 is not affected thereby.

As the piston 412 moves axially within the cylinder 418 the skirted seal 416 seals against an outer surface of the piston 412, thereby displacing air within the cylinder 418. In an embodiment of the invention, particularly low-volume pipettes (e.g. less than 100 μl according to the invention, the sealing portion of the piston 412 may be made from polished stainless steel. As noted above, stainless steel is considerably more dense and heavy than plastic, but it provides excellent surface smoothness and hardness, and in low-volume pipettes this material would not add appreciably to the overall weight of the device.

A spring clip 450 is interposed between the piston 412 and the pushbar 240, positioned against an upper abutment surface 454 of the pushbar 240. The spring clip 450 serves to secure and center the piston 412 in a desired position within the pushbar 240. The spring clip will be discussed in further detail below, with reference to FIGS. 7 and 8.

As noted above, a different embodiment of piston-cylinder assembly may be employed in multichannel pipettes according to the invention, particularly larger-volume embodiments (e.g., 100 μl or larger). Such an alternative configuration is illustrated in FIG. 5.

The 200 μl piston-cylinder assembly of FIG. 5 includes a piston 512, preferably fabricated from a molded polymer material (such as the PEI employed in various other portions of a pipette according to the invention).

During operation of the pipette, the piston 512 moves into and out of a corresponding cylinder 580. An annular seal ring 582 comprising an EPDM rubber lip seal is affixed near the proximal end of each of the axially moving pistons, and the lip seal moves axially with the piston 512, sealing against a smooth inner surface 586 of the cylinder. In the disclosed embodiment, the seal ring 582 is kept in a preferred position on the piston 512 by a notch 584 defined by the piston. When the pipette is assembled, the seal ring 582 is stretched over the piston and released in the desired position; the notch 584 keeps the seal ring 582 in place during operation via an interference fit. In an embodiment of the invention, the interface between the seal ring 582 and the inner surface 586 of the cylinder 580 is lubricated with a suitable perfluoropolyether (PFPE) grease.

The bayonet joint 430 (FIG. 4) between the pushrod 218 and pushbar 240 (FIGS. 2-4) is illustrated in greater detail in FIGS. 6*a* through 6*d*, which is schematic and illustrative in nature.

Figure 6A:
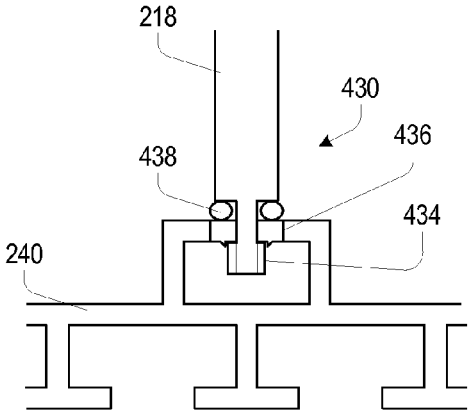
FIGS. 6*a* through 6*d* illustrate the operation of a compliant bayonet joint for connecting a pushrod to a pushbar in a liquid end of an exemplary pipette according to the invention.

As shown in FIG. 6*a* (and as previously described with reference to FIG. 4), the pushrod 218 is inserted through a resilient o-ring 438 and into a bayonet slot 436 defined by the pushbar 240. After insertion into the bayonet slot 436, the pushrod is rotated ninety degrees to lock the T-shaped flange 434 into position within the pushbar 240. As discussed above, and as illustrated in FIG. 6*b*, the pushbar 240 includes projections 620 protruding from an upper surface 440 (FIG. 4) of the pushbar 240; these projections tend to prevent the pushrod 218 and T-shaped flange 434 from rotating back into an unlocked orientation while the bayonet joint 430 is held together via compression of the o-ring 438.

In FIG. 6*a*, it will be observed that the o-ring 438 remains slightly compressed, and the T-shaped flange 430 is urged against the upper surface 440 of the pushbar 240, while the bayonet joint 430 is fully assembled. Accordingly, then, as the pushrod 218 is moved axially during operation of a pipette according to the invention, there is substantially no axial play between the pushrod 218 and the pushbar 240, and the pushbar accurately tracks the movement of the plunger rod of the pipette, and the pushbar remains perpendicular to the guide shaft 242.

Figure 6B:
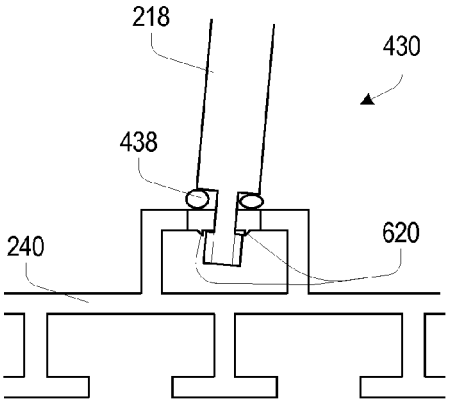

As noted above, however, the bayonet joint 430 is compliant, permitting some radial angular play in the pushrod 218 as shown in FIG. 6*b*. Although one side of the o-ring 438 may be more compressed than the other, and the pushrod 218 and the pushbar 240 are no longer perpendicular, it will be observed that the compliant bayonet joint 430 permits the pushbar 240 to remain perpendicular to the guide shaft 242, enabling excellent accuracy and channel-to-channel consistency in a multichannel pipette according to the invention. The angle of the pushrod 218 depicted in FIG. 6*b* is exaggerated for effect, and in practice any deviation observed is likely to be considerably smaller, with minimal effect on the overall accuracy of liquid measurement.

Figure 6C:
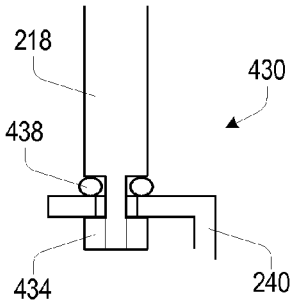
Figure 6D:
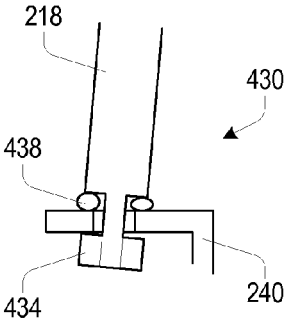

FIGS. 6*c* and 6*d* illustrate the compliant bayonet joint 430 from a side of the liquid end assembly according to the invention, perpendicular to the view offered in FIG. 3. As shown in FIG. 6*c*, the T-shaped flange 434 is wider than the bayonet slot 436 (once rotated into position), and the flange 434 is urged against the upper surface 440 of the pushbar 240. And as shown in FIG. 6*d*, radial displacement of the cupped receptacle 220 (FIG. 2) will allow the pushrod 218 to angle somewhat from perpendicular to the pushbar 240—and in doing so, the T-shaped flange 434 may rock slightly away from the upper surface 440 of the pushbar 240 (though the T-shaped flange 434 may be contoured to minimize this effect in practice). However, the pushbar 240 will remain perpendicular to the guide shaft 242 as desired, and the accuracy and performance of the pipette will tend to be maintained.

Clearly, then, the compliant bayonet joint 430 used in connection with the cupped receptacle 220 of the pushrod 218 is particularly advantageous, in that it allows a pipette according to the invention to be operated—even with some misalignment of parts—without applying any significant torque or moment to the pushbar.

Figure 7:
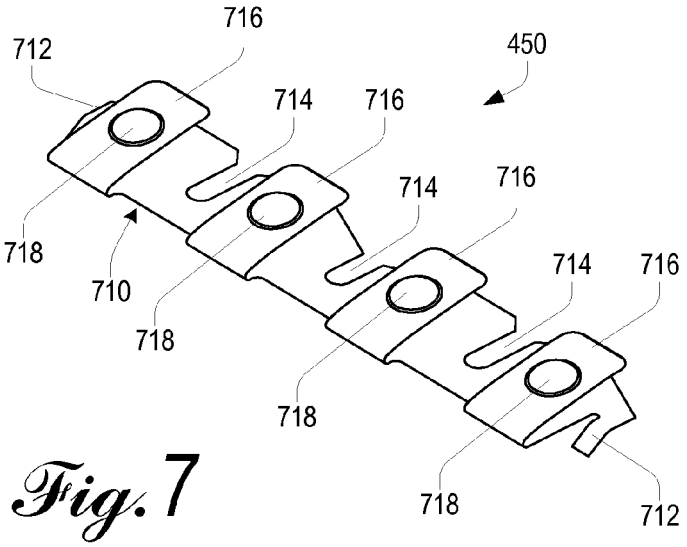
FIG. 7 illustrates an exemplary spring clip used to retain pistons within a pushbar according to FIG. 4.

The spring clip 450 is illustrated in greater detail in FIG. 7. As observed above, the spring clip 450 is preferably stamped and formed from stainless steel, but it should be noted that other suitable resilient materials may be used in this application, including but not limited to other metals or plastics. The material should be selected for adequate performance; stainless steel has been found to provide a good balance of durability, weight, cost, and resilience.

The illustrated spring clip is adapted to be positioned between the pushbar 240 and its pistons, such as the piston 412 (FIG. 4). The spring clip 450 shown in FIG. 7 accommodates four pistons, and accordingly two such spring clips are required for an eight-channel pipette, and three are required for a twelve-channel pipette. Other available configurations will be apparent.

The pushbar 240 illustrated in FIG. 4 is provided with one or more apertures 452 or recesses to accommodate the attachment tabs 712 on the spring clip 450. With the spring clip 450 inserted into place in the 240, the attachment tabs 712 extend into corresponding apertures 452, preventing the spring clip from undesired lateral movement under force from a piston 412 or other influence. The cooperative tabs 712 and apertures 452 keep the spring clip 450 securely in place. As noted above, the spring clip 450 includes a flat surface 710 that is positioned securely against the flat upper abutment surface 454 of the pushbar 240, and the cooperative tabs 712 and apertures 452 keep it in that desired position.

In the illustrated (four-channel) version of the spring clip 450, a plurality of slots 714 are defined by the spring clip 450, which straddle walls 456 of the pushbar 240 between adjacent channels thereof. The spring clip 450 provides a resilient finger 716 for each of the channels it supports, and the resilient finger 716 is provided with a protruding bump 718 cooperative with an indentation 468 on the proximal flared head 470 of the piston 412 (FIG. 4). With the piston 412 inserted partway into the cylinder 418, the entire piston-and-cylinder assembly may be installed into the liquid end assembly 120 by pushing the flange 472 of the cylinder 418 into a corresponding slot 236 (FIG. 2) in the rear portion 128 of the housing 122, and also pushing the flared head 470 of the piston 412 into the pushbar 240, with the indentation 468 defined by the flared head 470 engaging the protruding bump 718 on the spring clip 450. Accordingly, installation and removal of cylinders and pistons from a multichannel pipette according to the invention may be accomplished without tools, and features on the cylinder 418 and housing 122 (the flanges 472 and cylinder slots 236, respectively) and features on the piston 412 and spring clip 450 (the indentation 468 and protruding bump 718) serve to maintain the cylinder assembly in proper alignment.

The piston 512 illustrated in FIG. 5 also includes an indentation 568 defined in a proximal flared head 570, and accordingly, the piston-cylinder assembly of FIG. 5 assembles with its pushbar and corresponding spring clip in a similar manner, though dimensions may vary to accommodate whether it is employed in a smaller-volume or larger-volume pipette according to the invention.

Figure 8:
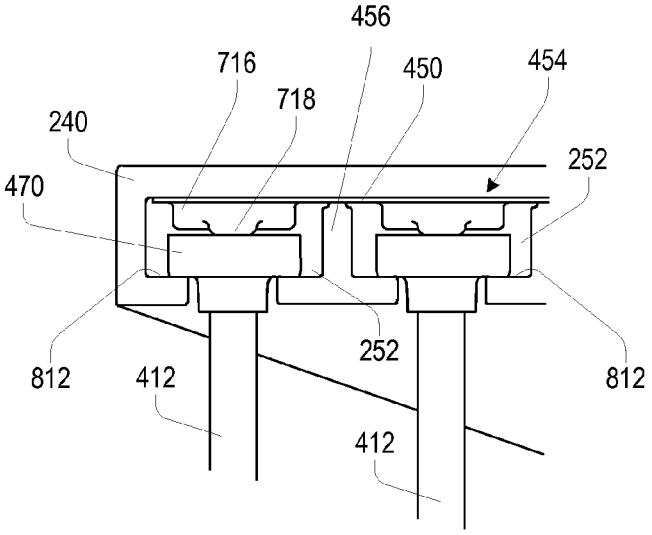
FIG. 8 illustrates in schematic form how the spring clip of FIG. 7 holds pistons within a pushbar in an embodiment of a pipette according to the invention.

FIG. 8 illustrates the role of the spring clip 450 (FIGS. 4, 7) in retaining pistons 412 within the pushbar 240.

As described above with reference to FIGS. 4 and 7, the spring clip 450 inserts into the pushbar 240, with a flat surface 710 (FIG. 7) of the spring clip 450 held against the flat upper abutment surface 454 of the pushbar 240. With the spring clip 450 so positioned, each of the fingers 716 (FIG. 7) of the spring clip 450 projects into a corresponding piston head slot 252 defined by the pushbar 240. When a piston 412 is inserted into its corresponding piston head slot 252, the finger 716 and its protruding bump 718 urge the proximal flared head 470 of the piston 412 against a lower surface 812 of the piston head slot 252. The protruding bump 718 projects into the indentation 468 (FIG. 4) of the flared head 470, preventing the piston 412 from sliding out of the piston head slot 252. The piston/cylinder assembly of FIG. 5 is configured similarly, with the protruding bump 718 of the spring clip 450 projecting into the indentation 568 of the flared head 570 of the piston 512 employed in that embodiment.

As noted above with reference to FIGS. 4 and 7, the spring clip 450 defines a plurality of slots 714 between adjacent fingers 716. These slots 714 fit around walls 456 between adjacent piston head slots 252, permitting a single spring clip 450 to be employed for multiple channels in a multichannel pipette according to the invention. The spring clip 450 illustrated herein includes four fingers 716 to retain four pistons 412; other configurations are possible.

In operation, the spring clip 450 (and its fingers 716 and protruding bumps 718) continues to resiliently urge the flared heads 470 of the pistons 412 against the lower surface 812 of the piston head slot 252 with little or no axial play, ensuring accurate performance. Although the spring clip 450 is designed to deform and allow the pistons 412 to move away from the lower surface 812 during assembly and service, during operation the flared heads 470 of the pistons 412 ordinarily remain depressed against the lower surface 812. However, it should be noted that some temporary flex may be tolerated during operation without loss of accuracy, as long as the pistons remain in the proper position at the beginning and end of each pipetting stroke.

It should be observed that while the foregoing detailed description of various embodiments of the present invention is set forth in some detail, the invention is not limited to those details and a pipette made according to the invention can differ from the disclosed embodiments in numerous ways. In particular, it will be appreciated that embodiments of the present invention may be employed in many different liquid-handling applications. It should be noted that functional distinctions are made above for purposes of explanation and clarity; structural distinctions in a system or method according to the invention may not be drawn along the same boundaries. Hence, the appropriate scope hereof is deemed to be in accordance with the claims as set forth below.

What is claimed is:

1. A liquid end assembly for a multichannel pipette, the liquid end assembly comprising:

a housing for the liquid end assembly, wherein the housing is configured to receive a plunger rod from a coupled pipette body;

a pushrod adapted to couple to the plunger rod, wherein the pushrod is mounted for axial movement in the housing in concert with axial movement of the plunger rod;

a pushbar;

a plurality of air displacement cylinders mounted within a bottom portion of the housing;

a plurality of pistons each coupled to the pushbar and mounted for axial movement in and through an open upper end of one of the cylinders in response to axial movement of the pushrod in the housing; and a plurality of nozzles, each connected to a respective one of the plurality of cylinders, and each with a lower open end extending from a bottom wall of the housing;

wherein the pushbar is coupled to the pushrod via a compliant interface comprising a bayonet joint and a resilient o-ring between the pushrod and the pushbar, the compliant interface configured to enable radial angular displacement of the pushrod but remain substantially free of axial play between the pushbar and the pushrod.

2. The liquid end assembly of claim 1, wherein the housing, pushbar, cylinders, and nozzles comprise molded polymer parts.

3. The liquid end assembly of claim 1, wherein the compliant interface comprises a captive joint.

4. The liquid end assembly of claim 1, wherein the pushbar defines a bayonet slot adapted to receive a distal end of the pushrod and the bayonet joint further comprises a T-shaped flange at the distal end of the pushrod and the bayonet slot defined by the pushbar, wherein the T-shaped flange is adapted to fit into the bayonet slot.

5. The liquid end assembly of claim 4, wherein the T-shaped flange is adapted to be rotated inside the pushbar to lock the bayonet joint.

6. The liquid end assembly of claim 1, further comprising a guide shaft coupled to the housing and a bearing coupled to the pushbar, the bearing including an annular inner surface configured to fit upon the guide shaft and slide along the guide shaft in response to the axial movement of the pushrod in the housing.

7. The liquid end assembly of claim 6, wherein the guide shaft is fabricated from stainless steel and the bearing is fabricated from brass.

8. The liquid end assembly of claim 1, further comprising a seal between each of the plurality of pistons and its corresponding cylinder.

9. The liquid end assembly of claim 8, wherein the seal comprises a stationary seal between a seal ring near a proximal end of the cylinder and a substantially cylindrical surface portion of the piston.

10. The liquid end assembly of claim 9, wherein the stationary seal comprises a compressed o-ring.

11. The liquid end assembly of claim 9, wherein the stationary seal comprises a skirted seal.

12. The liquid end assembly of claim 8, wherein the seal comprises a moving seal between a seal ring mounted to the piston and a substantially cylindrical portion of an inner wall of the cylinder.

* * * * *